United States Patent [19]

O'Gara

[11] Patent Number: 4,823,571

[45] Date of Patent: Apr. 25, 1989

[54] CAM LOCK AND BRACE ASSEMBLY

[76] Inventor: James O'Gara, 444 W. 258th St., Riverdale, N.Y. 10471

[21] Appl. No.: 235,366

[22] Filed: Aug. 23, 1988

[51] Int. Cl.[4] ..... E05B 65/06

[52] U.S. Cl. ..... 70/139; 70/417; 70/418; 70/462

[58] Field of Search ..... 70/135, 137, 139, 462, 70/417, 418; 292/244

[56] References Cited

U.S. PATENT DOCUMENTS

| | | | |
|---|---|---|---|
| 605,353 | 6/1898 | Smith et al. | 70/418 |
| 1,326,554 | 12/1919 | Watsa | 292/22 |
| 2,255,402 | 9/1941 | Vile | 70/139 |

*Primary Examiner*—Robert L. Wolfe

*Attorney, Agent, or Firm*—Herbert Dubno; D. Ronald Lianides

[57] ABSTRACT

A sleeve has at least one formation adapted to hold the sleeve against rotation in a similarly formed opening provided in a panel to be locked against a frame, a lock cylinder rotatably seated in the sleeve and traversing same to extend beyond an end thereof, the extension of the lock cylinder formed with a shank portion having one end of an elongated camming tongue mounted thereon and rotatable by the lock cylinder between a locked position in which the other end of the tongue extends across a separation between the panel and the frame and engages the frame, and an unlocked position in which the tongue lies wholly within an outline of the panel, and brace means mounted on the sleeve and extending substantially to the separation and formed with at least one slot adapted to receive the tongue at least in the locked position thereof.

14 Claims, 4 Drawing Sheets

CAM LOCK AND BRACE ASSEMBLY

FIELD OF THE INVENTION

The present invention relates, in general, to cam lock assemblies, and, more particularly, to a cam lock and brace assembly.

BACKGROUND OF THE INVENTION

Cam lock assemblies are well known in the art and are usually used in mailboxes or electrical equipment or in any such installations having panel type doors and frames fabricated from sheet metal.

Cam lock assemblies usually comprise a rotatable lock cylinder disposed in a threaded sleeve having at least one flat or other formation which matches the noncircular outline of an opening formed in the door or frame of the equipment to be locked, the formation acting to keep the sleeve from rotating. The cylinder is provided with an elongated camming tongue fixed at one end thereto and which rotates with the cylinder between an unlocked position, in which the tongue lies wholly within the outline of the portion of the equipment on which the cylinder is mounted, and a locked position, in which the tongue extends from the one portion to the other portion of the equipment and engages therewith in a camming manner which draws the two portions of the equipment into abutment with one another.

One disadvantage with this type of locking system is that forced entry can be had by inserting a tool between the movable and stationary portions of the equipment to engage the tongue, which can then be bent out of engagement with the equipment, leaving same in an unlocked state.

OBJECTS OF THE INVENTION

It is therefore an object of the present invention to provide an improved cam lock assembly adapted to obviate the aforementioned disadvantage.

It is another object of the present invention to provide an improved cam lock assembly in which the camming tongue cannot be bent out of engagement with the equipment.

SUMMARY OF THE INVENTION

The above and other objects of the invention are met by a cam lock assembly in which a brace is mounted on the sleeve of the lock to provide support to the camming tongue at the separation between the movable and stationary portions of the equipment should bending of the tongue occur.

In one embodiment of the invention, the brace is U-shaped and has an opening having a noncircular outline matching that of the sleeve, the opening being formed in the web between the legs of the U, which flank the sleeve and are each formed with an open-ended slot adapted to receive the tongue in the locked position thereof, the dual slots enabling the brace to be mounted at either of two opposing edges of a panel.

In another embodiment of the invention, the open end of the U-shaped brace is closed by a folede over portion of one of the legs of the U, which underlies a folded over flange on the other leg to which the folded over portion can be welded or soldered or simply held by spring tension of the folded over portion against the flange.

In yet another embodiment of the invention, the brace is formed as a cylinder having a closed end in which the noncircular opening is provided, the wall of the cylinder being formed with an arcuate slot through which the tongue can extend and rotate between the locked and open positions.

In still another embodiment of the invention, the brace can be L-shaped, with one of the legs being formed with a circular opening by which the brace is mounted on the sleeve, enabling the brace to be freely rotatable thereon, the other leg of the L-shaped brace being formed with a closed slot traversed by the tongue, which acts to entrain the brace between the locked and unlocked positions of the tongue.

In a final embodiment of the invention, a substantially square face of a corner shaped brace is formed with a circular opening, a pair of adjacent edges of the face each being formed with a respective leg extending at a right angle to one another and each formed with an open-ended slot facing away from one another. A substantially square face plate is provided to be seated on the brace with a pair of adjacent edges thereof abutting the legs of the brace, and the face plate being formed with a noncircular opening adapted to lie in registration with the circular opening when thus seated and traversed by the noncircular sleeve.

In operation, the circular opening enables the brace to be rotated freely on the noncircular sleeve so as to lie with a leg thereof parallel to any edge of the door panel regardless of the direction of swing of the tongue into the locked position with the tongue traversing one of the slots, the position of the brace being maintained by the face plate nonrotatably mounted on the sleeve with the edges of the plate abutting the legs of the brace.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
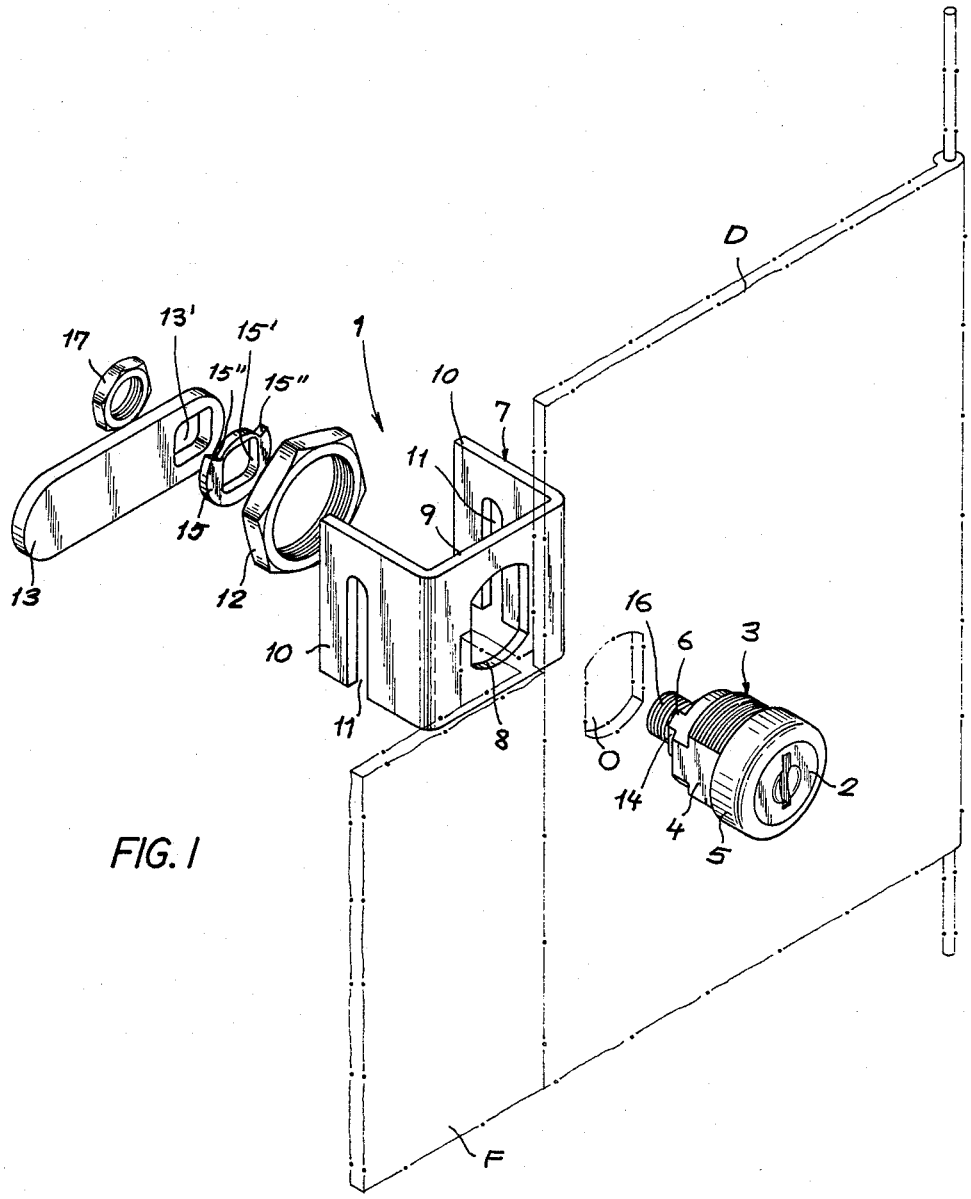
FIG. 1 is an exploded front perspective view taken from above of the lock assembly according to one embodiment of the invention.
Figure 2:
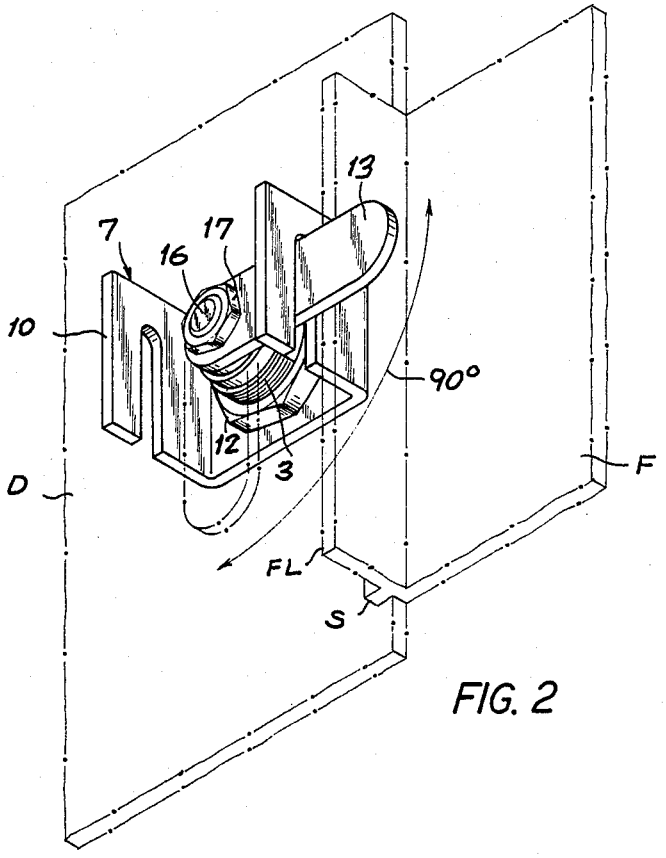
FIG. 2 is a rear perspective view taken from below of the assembled embodiment of FIG. 1.

In a first embodiment of the invention shown in FIGS. 1 and 2, the lock assembly 1 is adapted to be mounted, for purposes of illustration only, on a mailbox door D in a noncircular opening 0 thereof, the door D coacting with a door frame F, the door and frame being shown in phantom lines, the opening 0 being formed by a circle having opposing flats.

The lock assembly 1 consists of a lock cylinder 2 rotatably mounted in a threaded sleeve 3 having opposing flats 4, which coact with the flats of the opening 0 to prevent rotation of the sleeve 3. The sleeve 3 is further formed at one end with an enlarged head 5 which abuts the outer surface of the door D, and at the other end with a projection 6 which acts to limit the extent of the rotation of the lock cylinder 2, which will be further explained.

The sleeve 3 traverses the door and extends on the inside thereof and carries a U-shaped brace 7 having a noncircular opening 8 formed in the web 9 thereof and matching the outline of the opening 0 to seat on the sleeve 3 without rotation. A pair of legs 10 extend from the web 9 and flank the sleeve 3 and are each formed with a respective slot 11 adapted to receive a camming tongue 13. A nut 12 is threaded on the sleeve 3 and acts to hold the brace 7 against the inside surface of the door D, as well as mounting the sleeve on the door.

The lock cylinder 2 traverses the sleeve 3 and extends out of the other end thereof and is formed thereat with a square shank portion 14 which is adapted to receive a stop ring 15 having a matching square opening 15', as well as the camming tongue 13 having a matching square opening 13', the stop ring 15 having a reduced diameter portion forming a pair of shoulders 15'' engageable with the projection 6. A threaded stem 16 extends further from the shank 14 and receives a nut 17 threaded thereon which acts to hold the tongue 13 and ring 15 in place on the shank 14.

Figure 3:
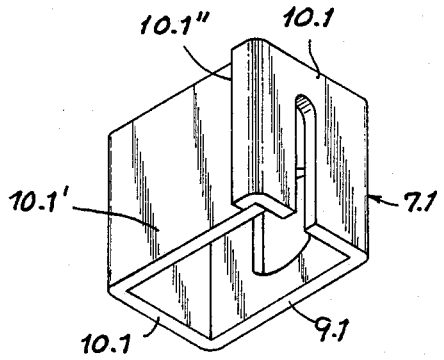
FIG. 3 is a rear perspective view taken from below of the brace according to another embodiment of the invention.

FIG. 3 illustrates another embodiment of the invention in which the brace 7.1 is basically the same as the brace 7 except for the legs 10.1, which are given more stability by a folded over portion 10.1' formed at the end of one of the legs and extending cross to the other leg and underlying a folded over flange 10.1'' formed at the end thereof to which the portion 10.1' can be welded or soldered or simply held in place by the spring tension of the folded portion 10.1' against the flange 10.1''. Otherwise, the web 9.1, noncircular opening 8.1, and slot 11.1 are substantially the same as that of the brace 7.

Figure 4:
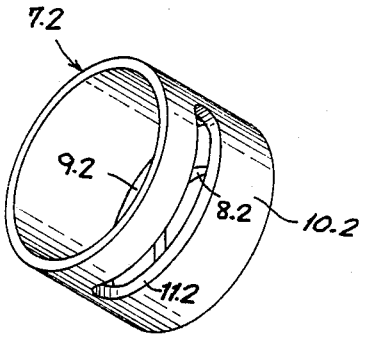
FIG. 4 is a rear perspective view taken from below of the brace according to yet another embodiment of the invention.

Yet another embodiment of the invention is shown in FIG. 4 in which the brace 7.2 is in the form of a cylinder having a closed end 9.2 in which the noncircular opening 8.2 is formed. The cylindrical wall 10.2 of the brace is formed with an arcuate slot 11.2 through which the tongue can extend.

Figure 6:
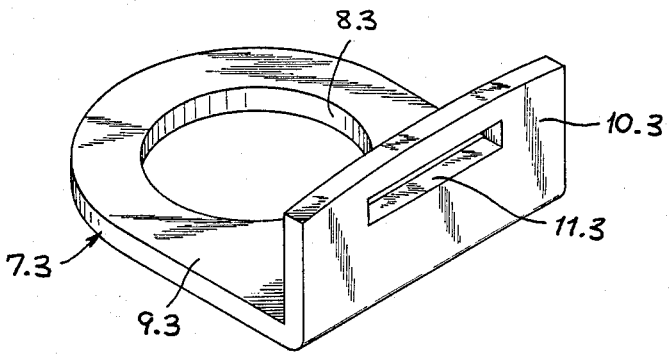
FIG. 6 is a perspective view of the brace of the embodiment of FIG. 5.
Figure 5:
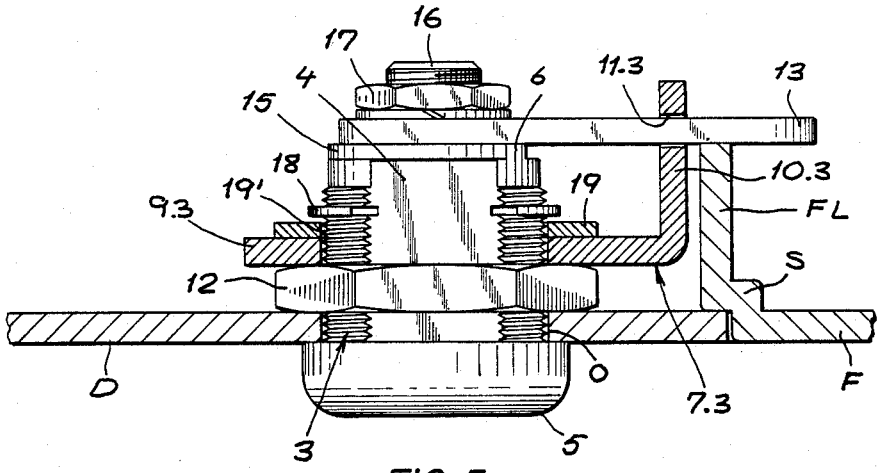
FIG. 5 is a sectional view of the lock assembly according to still another embodiment of the invention.

In still a further embodiment of the invention shown in FIGS. 5 and 6, the brace 7.3 is L-shaped and has one leg 9.3 thereof formed with a circular opening 8.3 enabling the free rotation of the brace 7.3 on the sleeve 3, which is retained on the sleeve by a snap ring 18 and spaced therefrom by a washer 19 held nonrotatably on the sleeve by a noncircular opening 19' formed in the washer. The other leg of the brace 7.3 is formed with a slot 11.3 traversed by the tongue 13, the brace extending substantially to the edge of the door D at the separation between the door and the frame F, which have been shown in FIG. 5 in full lines, the frame F being formed with a step S against which the door D abuts in the locked position, and a flange FL against which the tongue 13 engages.

Figure 7:
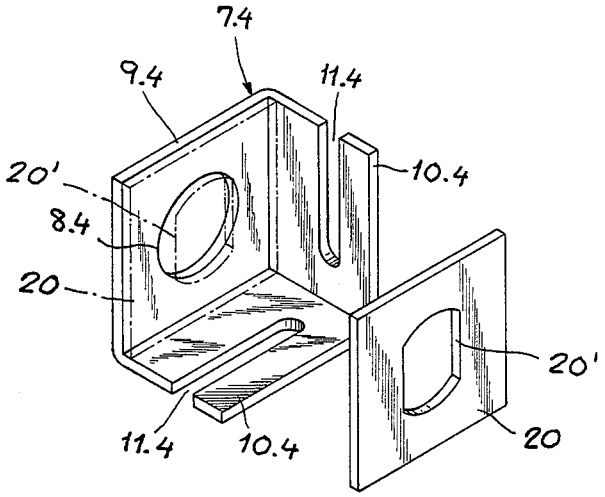
FIG. 7 is a rear perspective view taken from above of still a further embodiment of the invention.

In a final embodiment of the invention illustrated in FIG. 7, a substantially square face 9.4 of the corner shaped brace 7.4 is formed with a circular opening 8.4, a pair of adjacent edges of the face 9.4 each being formed with a respective leg 10.4 extending at a right angle to one another and each formed with an open-ended slot 11.4 facing away from one another. A substantially square plate 20 is provided to be seated on the brace 7.4 with a pair of adjacent edges thereof abutting the legs 10.4 of the brace, and the face plate 20 being formed with a noncircular opening 20' adapted to lie in registration with the circular opening when thus seated and traversed by the noncircular sleeve.

In the operation of the lock system illustrated in FIGS. 1 and 2, the key-operated lock cylinder 2 is restricted to substantially 90° of rotation by shoulders 15'' of the stop ring 15 engaging the projection 6. In the extreme positions of the lock cylinder, the tongue 13 is either in the open position or the locked position, the open position being shown in phantom lines in FIG. 2 and the locked position being shown in full lines. In the locked position, the tongue 13 is received in the slot 11 of the brace 7 where it can be held against bending in case of attempted forced entry, the tongue extending across the separation between the door and frame and engaging the flange FL of the frame in a camming movement which draws the door tightly against the seat S of the frame.

If the brace 7.1 shown in FIG. 3 is used in the lock assembly, the operation is identical, the folded portion 10.1' and flange 10.1'' being spaced from the web 9.1 by a distance sufficient to accommodate the axial length of the lock cylinder, and simply acting to add more stability the legs 10.1.

If the cylindrical brace 7.2 illustrated in FIG. 4 is used in the lock assembly, once again, the operation of the lock system is the same, the arcuate slot 11.2 being of a length sufficient to accommodate a 90° swing of the tongue 13, the tongue in this case being braced in both the locked and unlocked positions thereof.

Operationally, the lock assembly shown in FIGS. 5 and 6 is the same as already described, however, the L-shaped brace of this assembly is free to rotate on the sleeve 3 and is entrained by the tongue 13 to move therewith between the locked and unlocked positions, providing support for the tongue in all positions thereof.

It is also possible in the embodiment shown in FIG. 4 to form the opening 8.2 as a circular opening, in which case the cylindrical brace 7.2 would operate similarly to that of FIGS. 5 and 6.

In the operation of the embodiment illustrated in FIG.7, the circular opening 8.4 enables the brace 7.4 to be rotated freely on the noncircular sleeve so as to lie with a leg 10.4 thereof parallel to any edge of the door panel regardless of the direction of swing of the tongue into the locked position with the tongue traversing one of the slots 11.4, the position of the brace 7.4 being maintained by the face plate 20 nonrotatably mounted on the sleeve with the edges of the plate abutting the legs of the brace.

I claim:

1. A cam lock assembly comprising:

a sleeve having at least one formation adapted to hold said sleeve against rotation in a similarly formed opening provided in a panel to be locked against a frame;

a lock cylinder rotatably seated in said sleeve and traversing same to extend beyond an end thereof, the extension of said lock cylinder formed with a shank portion;

an elongated camming tongue mounted at one end thereof on said shank portion and rotatable by said lock cylinder between a locked position in which the other end of said tongue extends across a separation between said panel and said frame and engages said frame, and an unlocked position in which said tongue lies wholly within an outline of said panel; and brace means mounted on said sleeve and extending substantially to said separation and formed with at least one slot adapted to receive said tongue at least in the locked position thereof.

2. The lock assembly defined in claim 1 wherein said brace means includes a U-shaped member having a web extending between a pair of parallel legs adapted to flank said sleeve and said shank portion, at least one leg of said pair of legs formed with said slot for receiving said tongue, said web formed with a noncircular opening having an outline matching that of said sleeve for preventing rotation of said member on said sleeve.

3. The lock assembly defined in claim 2 wherein a free end of one leg of said pair of legs has a folded over portion extending to and underlying a folded over flange formed at a free end of the other leg of said pair of legs.

4. The lock assembly defined in claim 1 wherein said brace means includes a cylindrical member having a closed end formed with a noncircular opening having an outline matching that of said sleeve for preventing rotation of said member on said sleeve, a cylindrical wall of said member having a periphery substantially tangent to said separation, said cylindrical wall formed with an arcuate slot traversed by said tongue and having a length enabling said tongue to swing between said locked and unlocked positions.

5. The lock assembly defined in claim 1 wherein said brace means includes a cylindrical member having a closed end formed with a circular opening for the free rotation of said member on said sleeve, a cylindrical wall of said member having a periphery substantially tangent to said separation, said cylindrical wall formed with an arcuate slot traversed by said tongue, said tongue entraining said member when swinging between said locked and unlocked positions.

6. The lock assembly defined in claim 1 wherein said brace means includes an L-shaped member having a pair of perpendicularly arranged legs, one leg of said pair of legs formed with a circular opening for the free rotation of said member on said sleeve, the other leg of said pair of legs formed with a slot traversed by said tongue, said tongue entraining said member when swinging between said locked and unlocked positions.

7. The lock assembly defined in claim 1 wherein said brace means includes a corner shaped member having a substantially square face formed with a circular opening for the free rotation of said member on said sleeve, a pair of adjacent edges of said face each being formed with a respective leg extending at a right angle to one another and each formed with an open-ended slot facing away from one another for receiving said tongue in a locked position thereof, and a substantially square face plate adapted to be seated on said member with a pair of adjacent edges thereof abutting said legs, said face plate being formed with a noncircular opening in registration with said circular opening when thus seated and traversed by said noncircular sleeve, whereby said member is held against rotation by said face plate.

8. In a cam lock assembly of the type wherein a sleeve having a noncircular outline is held against rotation in a similarly formed noncircular opening provided in a panel to be locked against a frame, with a lock cylinder rotatably seated in said sleeve and traversing same to extend beyond an end thereof, and an elongated camming tongue fixed at one end thereof to the extension of said lock cylinder and rotatable therewith between a locked position in which the other end of said tongue extends across a separation between said panel and said frame and engages said frame, and an unlocked position in which said tongue lies wholly within an outline of said panel, the improvement comprising brace means mounted on said sleeve and extending substantially to said separation and formed with at least one slot adapted to receive said tongue at least in the locked position thereof.

9. The improvement defined in claim 7 wherein said brace means includes a U-shaped member having a web extending between a pair of parallel legs adapted to flank said sleeve and said extension, at least one leg of said pair of legs being formed with said slot for receiving said tongue, said web being formed with a noncircular opening having an outline matching that of said sleeve for preventing rotation of said member on said sleeve.

10. The improvement defined in claim 8 wherein a free end of one leg of said pair of legs has a folded over portion extending to and underlying a folded over flange formed at a free end of the other leg of said pair of legs.

11. The improvement defined in claim 7 wherein said brace means includes a cylindrical member having a closed end formed with a noncircular opening having an outline matching that of said sleeve for preventing rotation of said member on said sleeve, a cylindrical wall of said member having a periphery substantially tangent to said separation, said cylindrical wall formed with an arcuate slot traversed by said tongue and having a length enabling said tongue to swing between said locked and unlocked positions.

12. The improvement defined in claim 7 wherein said brace means includes a cylindrical member having a closed end formed with a circular opening for the free rotation of said member on said sleeve, a cylindrical wall of said member having a periphery substantially tangent to said separation, said cylindrical wall formed with an arcuate slot traversed by said tongue, said tongue entraining said member when swinging between said locked and unlocked positions.

13. The improvement defined in claim 7 wherein said brace means includes an L-shaped member having a pair of perpendicularly arranged legs, one leg of said pair of legs formed with a circular opening for the free rotation of said member on said sleeve, the other leg of said pair of legs formed with a slot traversed by said tongue, said tongue entraining said member when swinging between said locked and unlocked positions.

14. The improvement defined in claim 7 wherein said brace means includes a corner shaped member having a substantially square face formed with a circular opening for the free rotation of said member on said sleeve, a pair of adjacent edges of said face each being formed with a respective leg extending at a right angle to one another and each formed with an open-ended slot facing away from one another for receiving said tongue in a locked position thereof, and a substantially square face plate adapted to be seated on said member with a pair of adjacent edges thereof abutting said legs, said face plate being formed with a noncircular opening in registration with said circular opening when thus seated and traversed by said noncircular sleeve, whereby said member is held against rotation by said face plate.

* * * * *